US008051872B2

(12) United States Patent
Lenz

(10) Patent No.: US 8,051,872 B2
(45) Date of Patent: Nov. 8, 2011

(54) SUBSEA EQUIPMENT

(75) Inventor: Norbert Lenz, Celle (DE)

(73) Assignee: Cameron International Corporation, Houston, TX (US)

( * ) Notice: Subject to any disclaimer, the term of this patent is extended or adjusted under 35 U.S.C. 154(b) by 584 days.

(21) Appl. No.: 12/090,556

(22) PCT Filed: Oct. 19, 2005

(86) PCT No.: PCT/EP2005/011255

§ 371 (c)(1), (2), (4) Date: Apr. 17, 2008

(87) PCT Pub. No.: WO2007/045260

PCT Pub. Date: Apr. 26, 2007

(65) Prior Publication Data

US 2008/0245432 A1 Oct. 9, 2008

(51) Int. Cl.
*F16K 17/36* (2006.01)

(52) U.S. Cl. ..... 137/81.2; 137/236.1

(58) Field of Classification Search ..... 137/81.2, 137/236.1; 251/61, 62, 282; 60/398
See application file for complete search history.

(56) References Cited

U.S. PATENT DOCUMENTS

| | | | | |
|---|---|---|---|---|
| 3,163,985 | A * | 1/1965 | Bouyoucos | 60/398 |
| 3,677,001 | A * | 7/1972 | Childers et al. | 60/398 |
| 3,933,338 | A * | 1/1976 | Herd et al. | 251/63.6 |
| 4,185,652 | A * | 1/1980 | Zintz et al. | 137/78.2 |
| 4,294,284 | A * | 10/1981 | Herd | 137/613 |
| 6,250,199 | B1 * | 6/2001 | Schulte et al. | 91/4 R |

* cited by examiner

*Primary Examiner* — Stephen M Hepperle
*Assistant Examiner* — Kevin Murphy
(74) *Attorney, Agent, or Firm* — Conley Rose, P.C.

(57) ABSTRACT

A subsea equipment (1) used for natural gas or crude oil production, such as a subsea actuator (2) for a valve, a restrictor or the like, a control module or other means, comprises at least an oil-filled first component (3) and a compensator unit (4) which is associated with said first component and which is in fluid communication therewith for pressure compensation. To improve such a subsea equipment in a structurally simple manner in such a way that it is capable of functioning and that pressure compensation is still possible, even if the associated compensator unit is damaged or fails to operate, a second compensator unit (5) is in fluid communication with said first component (3) or said first compensator unit (4) for pressure compensation.

16 Claims, 2 Drawing Sheets

SUBSEA EQUIPMENT

CROSS-REFERENCE TO RELATED APPLICATION

The present application is a National Phase entry of PCT Application No. PCT/EP2005/011255 filed 19 Oct. 2005, hereby incorporated herein by reference.

STATEMENT REGARDING FEDERALLY SPONSORED RESEARCH OR DEVELOPMENT

Not Applicable.

BACKGROUND OF THE INVENTION

The invention relates to a subsea equipment used for natural gas or crude oil production, such as subsea actuators for a valves, restrictors or the like, control modules, so-called BOP (blowout preventors), or other means, and comprising at least one closed, oil-filled first component and a first compensator unit which is associated with said first component and which is in fluid communication therewith for pressure compensation, Such subsea equipment is arranged in situ on the seabed, on a so-called tree, on an oil platform and other components for natural gas or crude oil production. A subsea actuator serves e.g. to adjust a valve or a restrictor so as to interrupt, or at least vary the flow through respective pipes. Also for the so-called blowout preventor, an actuator is used. Such a blowout preventor serves to prevent, in emergency cases, crude oil or natural gas from escaping on the seabed from respective pipes at the well.

In the case of a closed, oil-filled subsea equipment, a respective component has normally associated therewith a compensator unit for pressure compensation. Pressure compensation is effected between the component and the environment, i.e. the water. The pressure compensated is the hydrostatic pressure (water depth) and also pressure differences caused by changes in temperature and/or volume. One example for a change in volume is here e.g. a piston which is movable in a cylinder.

In subsea equipments known in practice, a component or a plurality of components has associated therewith a respective compensator unit which accomplishes pressure compensation separately for the component associated therewith. If the compensator unit in question fails to operate due to the occurrence of a leak or the like, the function of the associated component will at least be impaired or the component will perhaps no longer be capable of functioning at all.

It is therefore the object of the present invention to improve a subsea equipment of the type referred to at the beginning in a structurally simple manner in such a way that it is still capable of functioning and that pressure compensation is still possible, even if the associated compensator unit is damaged or fails to operate. In connection with the features of the generic clause of claim 1, this object is achieved in that a second compensator unit is in fluid communication with the first component or the first compensator unit for pressure compensation.

BRIEF SUMMARY OF THE PREFERRED EMBODIMENTS

This can, on the one hand, be accomplished by a suitable connection between the second compensator unit and the first component. This offers the possibility of still using the second compensator unit for pressure compensation if the first compensator unit should fail to operate. In this way, the two compensator units are independent from and redundant with regard to one another.

On the other hand, there is the possibility of connecting the second compensator unit to the first compensator unit so that pressure compensation is essentially effected via the first compensator unit by means of the second compensator unit.

In accordance with an advantageous embodiment of the present invention, the second compensator unit can be associated with a second closed, oil-filled component for pressure compensation. The second compensator unit thus fulfils essentially a dual function in that it provides, on the one hand, pressure compensation for the second component and allows, on the other hand, pressure compensation for the first component or the first compensator unit via the connection to said first component or to said first compensator unit, possibly in combination with said first compensator unit.

Various embodiments of the respective compensator units are imaginable. One example, which is used comparatively often in subsea equipments, makes use of a bladder accumulator as a compensator unit. Such a bladder accumulator is used e.g. also as a pressure accumulator in hydraulic equipment. Such a bladder accumulator is essentially characterized in that it utilizes a bladder or a membrane as a compensator element, said bladder or membrane having on one side thereof seawater and on the other side thereof a compensating fluid, such as a hydraulic fluid, transmission oil, a low-viscosity substance or the like. These substances will be referred to as hydraulic fluid in the following. The pressure difference is compensated by contracting and expanding the bladder or the membrane. It is possible to realize one or both of said compensator units by such a bladder accumulator.

In accordance with a further embodiment, the first and/or second compensator unit(s) is/are implemented as piston accumulator(s). Such a piston accumulator comprises a piston which is longitudinally displaceable in a cylinder. The piston as such serves as a compensator element. Also in this case, seawater is on one side and hydraulic fluid on the other side of the piston.

It is also possible to implement the first and/or second compensator unit(s) as pressure accumulator(s). Such a pressure accumulator has a pressure fluid on one side of the compensator element, whereas on the other side of said compensator element there is again the hydraulic fluid. The pressure of the pressure fluid can be changed externally for pressure compensation, the amount of the pressure fluid being in this case increased or reduced.

Various embodiments of the first and also of the second component are imaginable. One example of the first and/or second component(s) is an actuator or a spring package. The actuator normally comprises a displacement element which is adapted to be displaced for operating a valve, a restrictor or the like. The spring package is used e.g. in connection with such an actuator so as to allow a definite starting position of the actuator even if said actuator fails to operate, said spring package being biased in the direction of this position.

Such a spring package is normally used with a bladder accumulator as a compensator unit. This bladder accumulator can be arranged externally of said spring package in the seawater surrounding the subsea equipment.

The actuator, which normally has an actuator housing, has associated therewith a bladder accumulator or a piston accumulator as a compensator unit. Said compensator unit is arranged, at least partially, in the interior of the actuator, i.e. of the housing of said actuator.

In order to establish the respective fluid connection, bores in the interior of the subsea equipment are imaginable, said bores establishing the fluid connection in question. For allowing more variations, the fluid connection can be implemented between the first compensator unit and the first component, the first compensator unit and/or the second compensator unit and/or the second compensator unit and the second component as respective hydraulic lines extending between the elements in question.

The hydraulic lines may also extend, at least partially, outside of the respective subsea equipment.

Such a subsea equipment also uses components, such as an actuator, which would no longer be capable of functioning within a short time after the ingress of water through the compensator unit, i.e. the actuator would have to be removed and pulled to the surface, and another actuator would have to be installed in the meantime, or the whole subsea equipment would not longer be capable of functioning. Water may ingress through a leak e.g. in the compensator unit. In addition, it turned out that, especially in the case of a piston accumulator, algae and sediment will gather within a short time on the compensator element side which is in contact with seawater. This will lead to a failure of the compensator unit, i.e. the piston in question will no longer be displaceable so as to accomplish pressure compensation.

In accordance with the present invention it is possible that the side located opposite the hydraulic side of the compensator element has supplied thereto hydraulic fluid from the other component or from the other compensator unit so that there will be no seawater on this side, i.e. that at least in the case of the first compensator unit associated with the actuator hydraulic fluid is present on both sides of the compensator element. This can be realized e.g. in that the respective fluid connection terminates in the interior of the compensator unit on both sides of the compensator element. The compensator element is thus connected on one side thereof to the actuator for pressure compensation, whereas the other side of said compensator element is connected to the other component or the other, second compensator unit.

A gathering of algae or sediments will be prevented in this way and the compensator unit will be protected against failure. Also an ingress of water into the actuator through the associated compensator unit will be prevented in this way. This will enhance the reliability of the actuator.

If the compensator unit of the actuator should fail to operate, no seawater can ingress into the actuator. Pressure compensation will then be taken over e.g. by the compensator unit of the spring package.

If the compensator unit of the spring package should fail to operate in this connection, a direct ingress of water into the actuator is impossible once more, and even the pressure compensation in the actuator will be maintained, since pressure compensation will still take place via the respective fluid connection to the other component and to the other compensator unit, respectively.

If both compensator units should fail to operate, the seawater will have to cover a long distance until it reaches the actuator. The seawater will first flow into the spring package through the spring-package compensator unit which is still in contact with seawater; in said spring package a sufficient amount of seawater will have to gather and flow then through the fluid connection to the first compensator unit and finally up to the actuator. This is, however, a very long way, partly through tubing having a small cross-section and substantially without any pressure differences, so that also in this case, the actuator will still be capable of operating for a long time and a failure of the actuator will normally be unlikely.

For reasons of redundancy, it is also possible to connect also in this respect at least one additional compensator unit in parallel with said first and/or second compensator unit(s), this means that e.g. the compensator unit associated with the spring package is implemented twice and in parallel and/or that the compensator unit associated with the actuator is implemented twice and also in parallel. In the case of the compensator units of the actuator the fluid connection to the other component or to the other compensator unit or units is established accordingly, as has already been explained hereinbefore.

A simple way of pressure compensation can also be accomplished without a pressure accumulator with a respective pressure fluid by opening at least one compensator unit on one side thereof towards the environment. The compensator unit in question is normally the second compensator unit which is not associated with the actuator, so as to prevent the above-described ingress of water into the actuator as reliably as possible.

It is, however, also possible that, contrary to the case where the actuator and the spring package are used, not both the components contribute to the function of the subsea equipment. If the two compensator units are not directly connected to one another, they may, for example, also have arranged between them an oil-filled container as a component. Also in this respect it will be of advantage when then first and second compensator units are connected in series.

BRIEF DESCRIPTION OF THE DRAWINGS

In the following, an advantageous embodiment of the present invention will be explained in detail on the basis of the figures enclosed, in which.

DETAILED DESCRIPTION OF THE PREFERRED EMBODIMENTS

Figure 1:
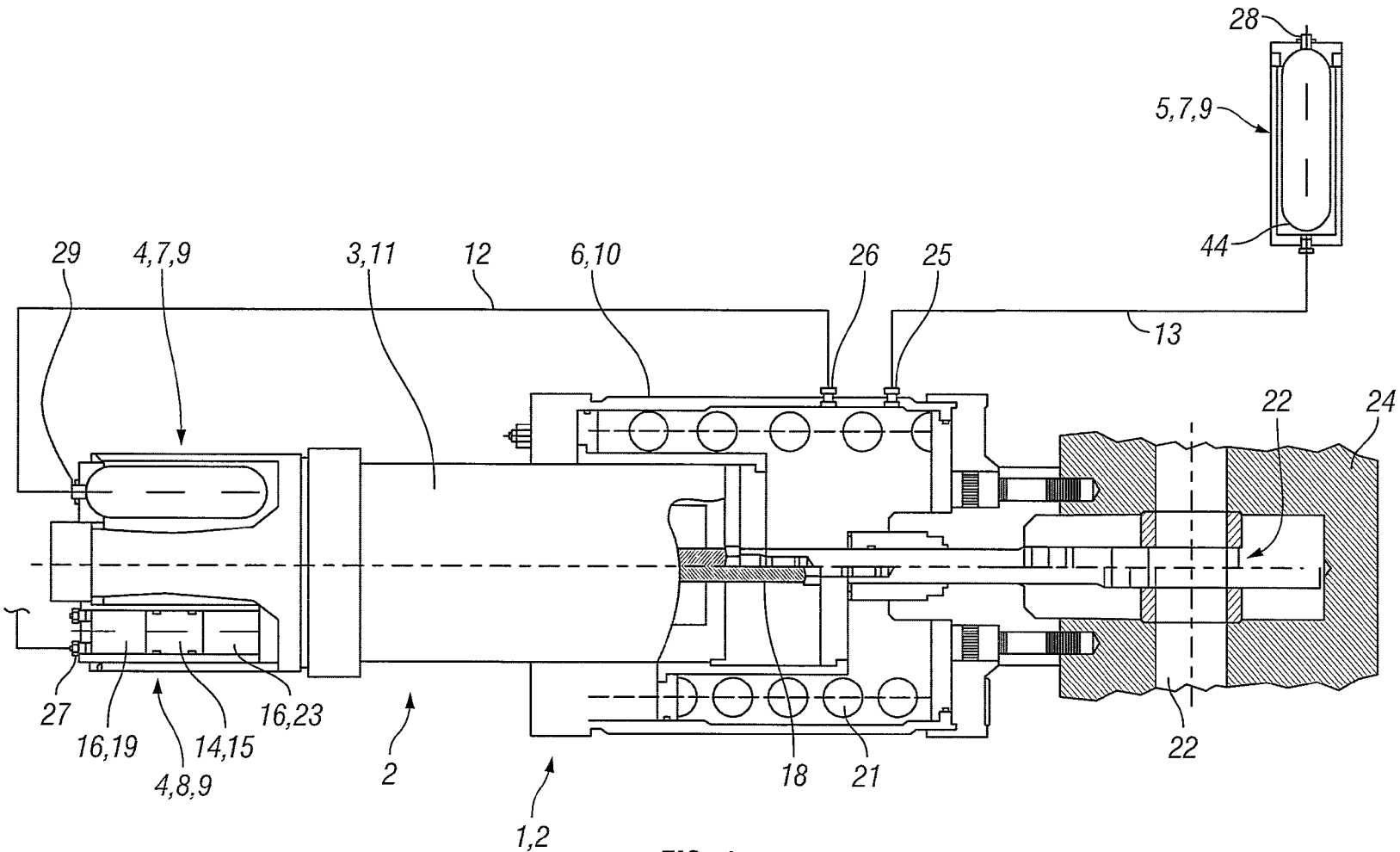
FIG. 1 shows a side view, partly in section, of a subsea equipment according to a first embodiment of the present invention.
Figure 2:
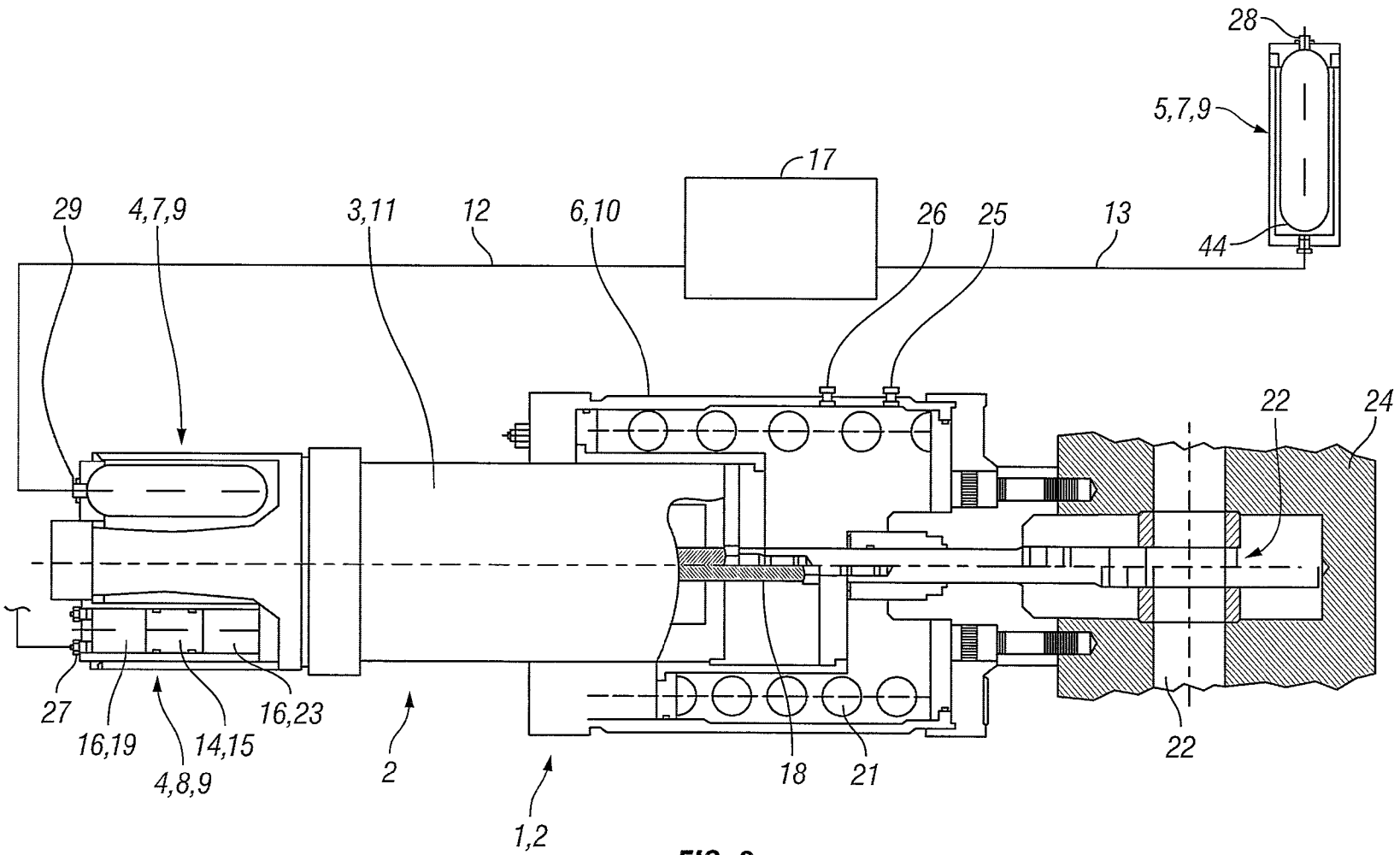
FIG. 2 shows a side view, partly in section, of a subsea equipment according to a second embodiment of the present invention.

FIG. 1 shows a side view, partly in section, of an embodiment of a subsea equipment 1 according to the present invention. This subsea equipment is implemented as a subsea actuator 2 with a spring package 10 comprising a spring element 21 as a second component 6 and an actuator 11 as a first component 3. The actuator 11 is electrically operated and is provided with a longitudinally displaceable operating element 18. This operating element 18 is shown in FIG. 1 in two different positions. In the upper half of the actuator 11, the operating element 18 is arranged at a retraced position at which a flow passage 22 through a housing 24 is blocked by means of a suitable blocking element 23. In the lower half of FIG. 1, the operating element 18 has been displaced to the right of the figure and opens the flow passage 22 with the blocking element 23.

Each of these components has associated therewith a compensator unit for pressure compensation. By means of this compensator unit, pressure compensation is provided between the closed, oil-filled components and the environment, i.e. seawater. What is compensated is the hydrostatic pressure corresponding to the water depth and also pressure differences resulting from changes in temperature and/or volume, cf. e.g. the displacement of the operating element 18 in the longitudinal direction.

The first component 3, i.e. the actuator 11, has associated therewith a bladder accumulator 7 as a first compensator unit 4. This bladder accumulator 7 is in fluid communication with the interior of the actuator at one end thereof (not shown). The other end of the bladder accumulator 7 is in fluid communication with the interior of the second component 6, i.e. the spring package 10, via an inlet 29 by means of a hydraulic line 12. Hence, the hydraulic line 12 terminates in the interior of the spring package 10 via a connection 26. Adjacent to said connection 26, a connection 25 is arranged through which a fluid connection is established between the second component 6 and a second compensator unit 5 by means of the hydraulic line 13. Also this second compensator unit 5 is implemented as a bladder accumulator.

It is possible to implement both bladder accumulators also as pressure accumulators 9; in this case a suitable pressure fluid would additionally be provided. The amount of said pressure fluid can be controlled externally for varying the pressure and thus the pressure compensation by means of the first and second components.

Normally, the second compensator unit 5 will, however, be open towards the seawater via an outlet 28.

In FIG. 1 a piston accumulator 8 acting as a first compensator unit 4 is shown, as an alternative, below the first compensator unit 4. Such a piston accumulator 8 comprises a piston 15 as a compensator element 14, said piston 15 being displaceably supported in a cylinder.

According to the present invention, hydraulic fluid is, also in the case of the bladder accumulators 7, filled in on either side of the respective compensator element 14, i.e. the interior 16 of the first compensator unit 4 is exclusively filled with hydraulic fluid, but not—not even on only one side of the compensator element 14—with seawater.

In FIG. 1, the interior 16 of the first compensator unit 4 is divided into a first side 19 and a second side 20 by the compensator element 14. This applies analogously also to the bladder accumulator. The second side 20 contains a hydraulic fluid which is in fluid communication with the actuator 11. The first side 19 contains hydraulic fluid which is in fluid communication with the second component 6 and the second compensator unit 5, respectively, via the inlet 27 and the respective hydraulic line 12. In this way, at least the first compensator unit 4 is prevented from containing seawater therein. In a piston accumulator, the seawater may otherwise have the effect that algae or sediment will gather on the first side 19 of the interior 16. This may lead to a failure of the compensator unit. In addition, a leak in the compensator unit may have the effect that seawater flows to the second side 20; such ingress of water would mean that, within a short time, the actuator would no longer be capable of functioning.

In FIG. 1, additional embodiments of the present invention are shown, of the broken lines indicating the hydraulic lines 12 and 13. In one embodiment, a direct connection between the second compensator unit 5 and the first compensator unit 4 can be established by the hydraulic lines 12 and 13. In this case, there would be no fluid connection between the first compensator unit and the second component 6. The respective fluid connection between the second component 6 and the second compensator unit 5 can, however, be maintained.

In a second embodiment, the second component 6 is not implemented as an active component for the subsea equipment 1, but it is replaced by an oil-filled container 17 arranged between the hydraulic lines 12 and 13. This oil-filled container essentially serves as an intermediate storage means for the hydraulic fluid.

Reference is additionally made to the fact that it is also possible to connect e.g. the first compensator unit 4 on its side 20 facing the actuator 3, 11 also, and instead of via the inlet 27, to the second component and the second compensator unit 5, respectively. This applies analogously, vice versa, also to the second compensator unit 5. Although this means that a certain advantage with regard to the absence of seawater in the first compensator unit 4 is given up, a redundant arrangement of the compensator units is obtained by the connection of the respective compensator units to the first and second components.

In addition, it is also possible to arrange, in addition to the first and second compensator units, at least one additional compensator unit, which is e.g. redundant to the first or second compensator unit, in that it is connected in parallel therewith, i.e. that, e.g. in addition to the first compensator unit 4, the compensator unit 4 shown in the lower half of FIG. 1 is actually used, and that both said compensator units are connected to the second component 6, the container 17 or the second compensator unit 5 via the hydraulic line 12. This applies analogously also to the second compensator unit 5, which can also be provided as a redundant component and which can be connected to the second component 6 or the container 17 via a respective hydraulic line 13.

What is claimed is:

1. A subsea actuator disposed in seawater comprising:

a first component comprising an interior;

a first compensator in fluid communication with said first component interior so as to form a first closed system with said first component interior, said first compensator configured to compensate the pressure within said first component interior;

a second component comprising an interior in fluid communication with said first compensator;

a second compensator in fluid communication with said second component interior so as to form a second closed system with said second component interior and said first compensator, said second closed system being discrete from said first closed system;

said second compensator being configured to compensate the pressure between said second component interior and the surrounding seawater such that pressure compensation provided by said second compensator to said second component can also be communicated to said first compensator to compensate pressure in said first component interior.

2. The subsea actuator of claim 1, further comprising a hydraulic line providing fluid communication between said second compensator and said second component.

3. The subsea actuator of claim 1, wherein at least one of said first and second compensators is one of a group consisting of a bladder accumulator, a piston accumulator, and a pressure accumulator.

4. The subsea actuator of claim 1, wherein at least one of said first and said second components is one of a group consisting of a spring package and an actuator.

5. The subsea actuator of claim 1, wherein said second compensator is open to the surrounding seawater.

6. The subsea actuator of claim 1, wherein said first compensator includes a compensator element disposed therewithin, wherein a hydraulic line providing fluid communication between said first compensator and said second component couples to a first side of the compensator element and said first component couples a second side of the compensator element.

7. The subsea actuator of claim 1, further comprising a third compensator connected in parallel with one of said first and second compensators.

8. A subsea actuator comprising:

a first component comprising an interior;

a first compensator in fluid communication with said first component interior so as to form a first closed system with said first component interior, said first compensator configured to compensate the pressure within said first component interior;

a second component comprising an interior in fluid communication with said first compensator;

a second compensator in fluid communication with said second component interior so as to form a second closed system with said second component interior and said first compensator, the second closed system being discrete from said first closed system;

said second compensator being configured to compensate the pressure between said second component interior and the surrounding environment such that the pressure compensation provided by the second compensator can also be communicated to said first compensator to compensate pressure in said first component interior.

9. The subsea actuator of claim 8, further comprising a hydraulic line extending between said second compensator and said second component.

10. The subsea actuator of claim 8, wherein at least one of said first and second compensators is one of a group consisting of a bladder accumulator, a piston accumulator, and a pressure accumulator.

11. The subsea actuator of claim 8, wherein at least one of said first and second components is one of a group consisting of a spring package and an actuator.

12. A subsea actuator comprising:

a first component comprising an interior;

a first compensator in fluid communication with said first component interior so as to form a first closed fluid system with said first component interior, said first compensator configured to compensate the pressure within said first component interior;

a second component comprising a storage container with an interior in fluid communication with said first compensator; and a second compensator in fluid communication with said second component interior so as to form a second closed system with said second component interior and said first compensator, the second closed system being discrete from said first closed system;

said second compensator being configured to compensate the pressure between said second component interior and the surrounding environment such that pressure compensation provided by said second compensator to said second component can also be communicated to said first compensator to compensate pressure in said first component interior.

13. The subsea actuator of claim 12, further comprising a first hydraulic line extending between said second component and said first compensator and a second hydraulic line extending between said second component and said second compensator.

14. The subsea actuator of claim 13, wherein at least one of said first and second compensators is one of a group consisting of a bladder accumulator, a piston accumulator, and a pressure accumulator.

15. The subsea actuator of claim 13, wherein at least one of said first and second components is one of a group consisting of a spring package and an actuator.

16. The subsea actuator of claim 12, further comprising a third compensator connected in parallel with one of said first and second compensators.

* * * * *